US009643702B2

(12) United States Patent
Shomura et al.

(10) Patent No.: US 9,643,702 B2
(45) Date of Patent: May 9, 2017

(54) INTAKE STRUCTURE OF OUTBOARD MOTOR

(71) Applicant: SUZUKI MOTOR CORPORATION, Hamamatsu-shi, Shizuoka (JP)

(72) Inventors: Nobuyuki Shomura, Hamamatsu (JP); Akinori Yamazaki, Hamamatsu (JP); Toshinori Kono, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 132 days.

(21) Appl. No.: 14/305,420

(22) Filed: Jun. 16, 2014

(65) Prior Publication Data

US 2014/0370768 A1 Dec. 18, 2014

(30) Foreign Application Priority Data

Jun. 17, 2013 (JP) ..... 2013-126660
Jun. 17, 2013 (JP) ..... 2013-126673
Jun. 17, 2013 (JP) ..... 2013-126938

(51) Int. Cl.

| | |
|---|---|
| ***F02M 35/16*** | (2006.01) |
| ***B63H 20/00*** | (2006.01) |
| ***F02M 35/12*** | (2006.01) |
| ***F02M 35/10*** | (2006.01) |

(52) U.S. Cl.

CPC ..... *B63H 20/001* (2013.01); *F02M 35/10013* (2013.01); *F02M 35/1211* (2013.01); *F02M 35/1288* (2013.01); *F02M 35/167* (2013.01)

(58) Field of Classification Search

CPC ..... F02M 35/167; F02M 35/168; F02M 35/10013; F01P 2050/12; F02B 61/045
USPC ..... 440/76, 77, 88 A
See application file for complete search history.

(56) References Cited

U.S. PATENT DOCUMENTS

| | | | | |
|---|---|---|---|---|
| 7,421,997 | B2 * | 9/2008 | Ishizaka | F02M 35/10013 123/195 P |
| 7,488,227 | B2 * | 2/2009 | Fujima | H01H 50/04 123/195 P |
| 7,517,265 | B2 | 4/2009 | Takahashi et al. | |
| 8,328,590 | B2 * | 12/2012 | Inaba | F02M 35/02 440/88 A |
| 8,851,945 | B2 * | 10/2014 | Harada | F02B 61/045 440/77 |
| 2008/0003896 | A1 | 1/2008 | Takashi et al. | |
| 2010/0147246 | A1 | 6/2010 | Inaba et al. | |

FOREIGN PATENT DOCUMENTS

| | | |
|---|---|---|
| JP | 3139176 | 2/2001 |
| JP | 2007-331666 | 12/2007 |
| JP | 2010-138858 | 6/2010 |

* cited by examiner

*Primary Examiner* — Andrew Polay
(74) *Attorney, Agent, or Firm* — Troutman Sanders LLP

(57) ABSTRACT

An intake structure of an outboard motor supplying intake air to an internal combustion engine for the outboard motor has an engine cover covering the internal combustion engine for the outboard motor, an inner cover disposed on an outside of the engine cover, and a top cover covering the inner cover. The inner cover and the top cover form an intake duct supplying intake air to the internal combustion engine for the outboard motor.

10 Claims, 11 Drawing Sheets

INTAKE STRUCTURE OF OUTBOARD MOTOR

CROSS-REFERENCE TO RELATED APPLICATIONS

This application is based upon and claims the benefit of priority of the prior Japanese Patent Application No. 2013-126660, filed on Jun. 17, 2013, the prior Japanese Patent Application No. 2013-126673, filed on Jun. 17, 2013, and the prior Japanese Patent Application No. 2013-126938, filed on Jun. 17, 2013, the entire contents of which are incorporated herein by reference.

BACKGROUND OF THE INVENTION

Field of the Invention

The present invention relates to an intake structure of an outboard motor which supplies intake air to an internal combustion engine for outboard motor.

Description of the Related Art

In general, an outboard motor is mounted on a rear section of a hull. In the rear section of the hull, waves can hit a rear surface of the outboard motor and climb upward or fall down when the ship goes rearward or rapidly decelerates. Particularly, depending on the state of water surface such as waves and swells, the shape of the hull, and the speed when going back, a large amount of water can be splashed onto the outboard motor. When the outboard motor is splashed with water, the water may enter the inside of the outboard motor and the outboard motor may fail. In an intake system of the outboard motor, a water separating function for separating water from the intake air is provided so as to correspond to being splashed with water.

Patent Document 1 has a cowling having a bottom cowl covering a bottom part of an engine and a top cowl covering an upper part of the engine. In the cowling, there is disposed a molding which partitions an air introduction chamber having a water separation structure and an engine housing chamber. Further, on the downstream of the molding, an air filter is disposed, and the air filter allows passage of only air to the engine housing chamber and blocks passage of water, salt, and garbage.

However, the molding disclosed in above-described Patent Document 1 is limited to a shape that can be disposed in the cowling since it is disposed in the cowling. That is, when the shape of the molding is changed to a shape which effectively separates air and water, it must be a shape housed within the cowling. Therefore, the shape of the molding is restricted, and thus there is a problem that it is uneasy to make a shape that effectively separates water from intake air.

Further, in general, the air inside the engine room of the outboard motor is higher in temperature than outside air due to heat radiation from the engine and a power generating device. There are outboard motors having a ventilation structure for exhausting such air inside the engine room to the outside to perform ventilation. Further, there are outboard motors having an intake passage formed independently inside the engine cover or in a cover different from the engine cover, in order to supply intake air to the engine.

The outboard motor disclosed in Patent Document 2 has an upstream intake silencer and a downstream intake silencer which are disposed outside the engine room. Air for combustion in an air intake space flows out into the upstream intake silencer via an air introduction port, and thereafter flows out to the downstream intake silencer via an air entrance port from an air lead-out port and flows out to a throttle passage via an air exit port. Further, the outboard motor of Patent Document 2 has a case in which a discharge passage part covering a transmission mechanism from above is constituted of a lower case and an upper case which is coupled air-tight to the lower case with screws, and a ventilation fan disposed in a discharge passage formed of the lower case and the upper case and sending air in a pressurized manner toward a lead-out passage.

However, although the outboard motor of above-described Patent Document 2 has the independent intake passage formed of a plurality of silencers, it is structured to be in direct contact with a ventilation space ventilated by a ventilation fan only via a partition plate such as an engine cover. Therefore, even when it has the independent intake passage, intake air temperature increases via the partition plate due to hot air in the ventilation space, where there is a concern that charging efficiency of intake decreases. Further, in order to reduce suction noise, the contact area between the intake passage and the ventilation space increases due to a silencer having a large volume, and thus the intake air temperature increases easily.

Further, generally, in an outboard motor, an intake manifold for supplying intake air to the engine is disposed at a position inside the engine cover and adjacent to the engine. Therefore, the intake manifold is heated by heat radiation of the engine and hot air in the engine cover, and the temperature of intake air in the intake manifold increases. Accordingly, there are outboard motors having a structure for cooling the intake manifold.

Patent Document 3 discloses an outboard motor provided with a water jacket for cooling intake air only in an engine side portion of an intake branch pipe constituting the intake manifold provided on one side in a traveling direction of a cylinder block. Cooling water for this water jacket for cooling intake air is supplied via a cooling water circulation path separate from a cooling water circulation path for cooling the engine. By the water jacket for cooling intake air, it is possible to prevent temperature increase of the intake manifold by heat on the engine side.

However, in the above-described cooling structure of the intake manifold disclosed in Patent Document 3, the structure becomes complicated because routing of the cooling water circulation path is necessary, and the weight of the outboard motor increases. Further, in the intake manifold, only the engine side portion is in contact with the water jacket for cooling intake air. Therefore, on an opposite side of the engine side of the intake manifold, the intake air is in contact with hot air in the engine cover and increases in temperature, where there is a concern that charging efficiency of intake air decreases.

Patent Document 1: Japanese Laid-open Patent Publication No. 2007-331666

Patent Document 2: Japanese Laid-open Patent Publication No. 2010-138858

Patent Document 3: Japanese Patent No. 3139176

SUMMARY OF THE INVENTION

The present invention has been made in view of the above-described problems, and it is an object thereof to provide an intake structure of an outboard motor that is capable of efficiently separating water from intake air.

Further, the present invention has been made in view of the above-described problems, and it is an object thereof to provide an intake structure of an outboard motor that is capable of improving charging efficiency of intake air by preventing increase in intake air temperature.

An intake structure of an outboard motor according to the present invention is an intake structure of an outboard motor supplying intake air to an internal combustion engine for outboard motor, the intake structure including: an engine cover covering the internal combustion engine for outboard motor; an inner cover disposed on an outside of the engine cover; and a top cover covering the inner cover, wherein the inner cover and the top cover form an intake duct supplying intake air to the internal combustion engine for outboard motor.

The intake duct disposed on an outside of the engine cover via a gap from the engine cover, wherein traveling air flows to the gap from a traveling air introduction port formed between the engine cover and the intake duct.

An intake structure of an outboard motor according to the present invention is an intake structure of an outboard motor supplying intake air to an internal combustion engine for outboard motor, the intake structure including: an engine cover covering the internal combustion engine for outboard motor; a heat insulating member insulating heat radiation from the internal combustion engine for outboard motor; and an intake manifold disposed between the engine cover and the heat insulating member and supplying intake air to the internal combustion engine for outboard motor, wherein traveling air which flowed in via an inflow port formed in a front surface part of the engine cover is brought into contact with an outside surface of the intake manifold, and discharged from a discharge port formed in a side surface part of the engine cover.

DETAILED DESCRIPTION OF THE PREFERRED EMBODIMENTS

Figure 1:
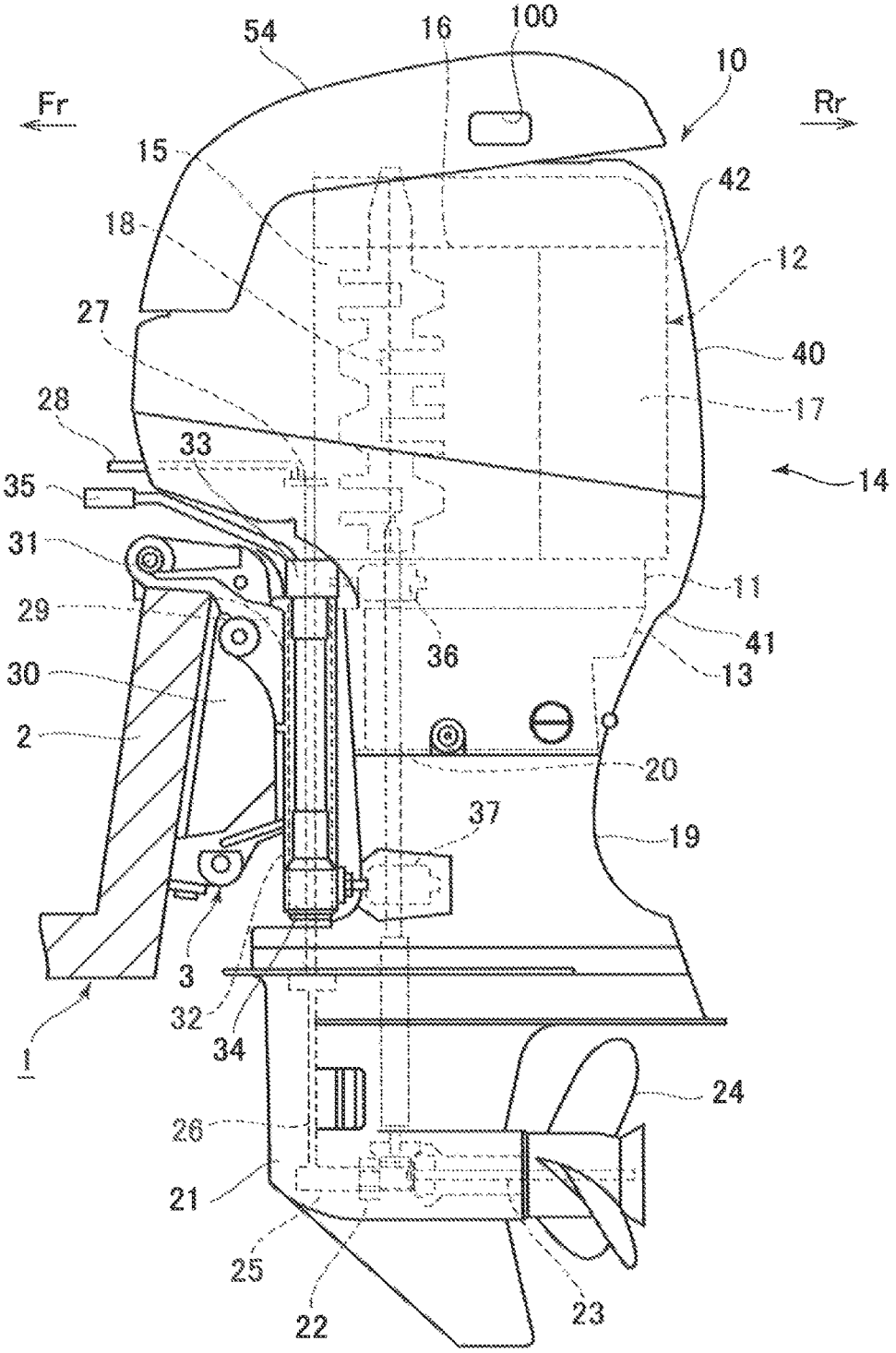
FIG. 1 is a left side view of an outboard motor.

Hereinafter, with reference to the attached drawings, a preferred embodiment of the present invention will be described with reference to the drawings. Note that in the drawings, as necessary, the front side of an outboard motor 10 (forward direction of a hull 1 on which the outboard motor 10 is mounted) is denoted by an arrow Fr, the rear side of the outboard motor 10 (backward direction of the hull 1 on which the outboard motor 10 is mounted) is denoted by an arrow Rr, the right side of the outboard motor 10 is denoted by an arrow R, and the left side of the outboard motor 10 is denoted by an arrow L.

FIG. 1 is a left side view of the outboard motor 10 mounted in the hull 1. The outboard motor 10 is mounted via a bracket device 3 on a transom 2 located in a rear section of the hull 1.

As illustrated in FIG. 1, the outboard motor 10 has an engine holder 11, and an engine (internal combustion engine for outboard motor) 12 is placed on an upper side of the engine holder 11. Further, on a lower side of the engine holder 11, an oil pan 13 is disposed. The surrounding of the engine 12, the engine holder 11, and the oil pan 13 of the outboard motor 10 is covered with a cover 14 made of synthetic resin constituted of an upper cover 40 and a lower cover 41. Further, the engine 12 is constituted of, for example, a crank case 15, a cylinder block 16, and a cylinder head 17 which are connected sequentially from the front side, and it is a vertical type engine in which a crank shaft 18 is disposed substantially vertically. In this embodiment, for example, a water-cooled four-cycle four-cylinder engine is used.

A drive shaft housing 19 is disposed on a lower side of the oil pan 13. A drive shaft 20 is disposed substantially vertically in the engine holder 11, the oil pan 13, and the drive shaft housing 19, and an upper end of the drive shaft is coupled to a lower end of the crank shaft 18. The drive shaft 20 extends downward in the drive shaft housing 19, and is structured to drive a propeller 24 via a bevel gear 22 and a propeller shaft 23 in a gear case 21 provided on a lower part of the drive shaft housing 19.

In the gear case 21, there is provided a shift device 25 which switches the rotation direction of the propeller shaft 23 to forward or reverse or to neutral by remote control. From this shift device 25, a shift rod 26 extends upward and is coupled to an operating rod 28 via a link 27.

The bracket device 3 is constituted mainly of a swivel bracket 29 and a transom bracket 30, and the swivel bracket 29 is fixed to the outboard motor 10 and the transom bracket 30 is fixed to the transom 2 of the hull 1.

The swivel bracket 29 is pivotally supported to be capable of tilting vertically via a tilt shaft 31 bridged across a pair of left and right transom brackets 30, and a pilot shaft 32 is pivotally supported rotatably in a vertical direction in this swivel bracket 29. Further, on an upper and a lower end of this pilot shaft 32, an upper mount bracket 33 and a lower mount bracket 34 are provided respectively to be integrally turnable. Then, a steering bracket 35 is provided in an upper mount bracket 33, and is coupled to a not-illustrated cable or the like.

On the other hand, on a front section of the engine holder 11, a pair of left and right upper mount units 36 is provided and is coupled to the upper mount bracket 33. Further, on both side sections of the drive shaft housing 19, a pair of lower mount units 37 is provided and coupled to the lower mount bracket 34.

Figure 2:
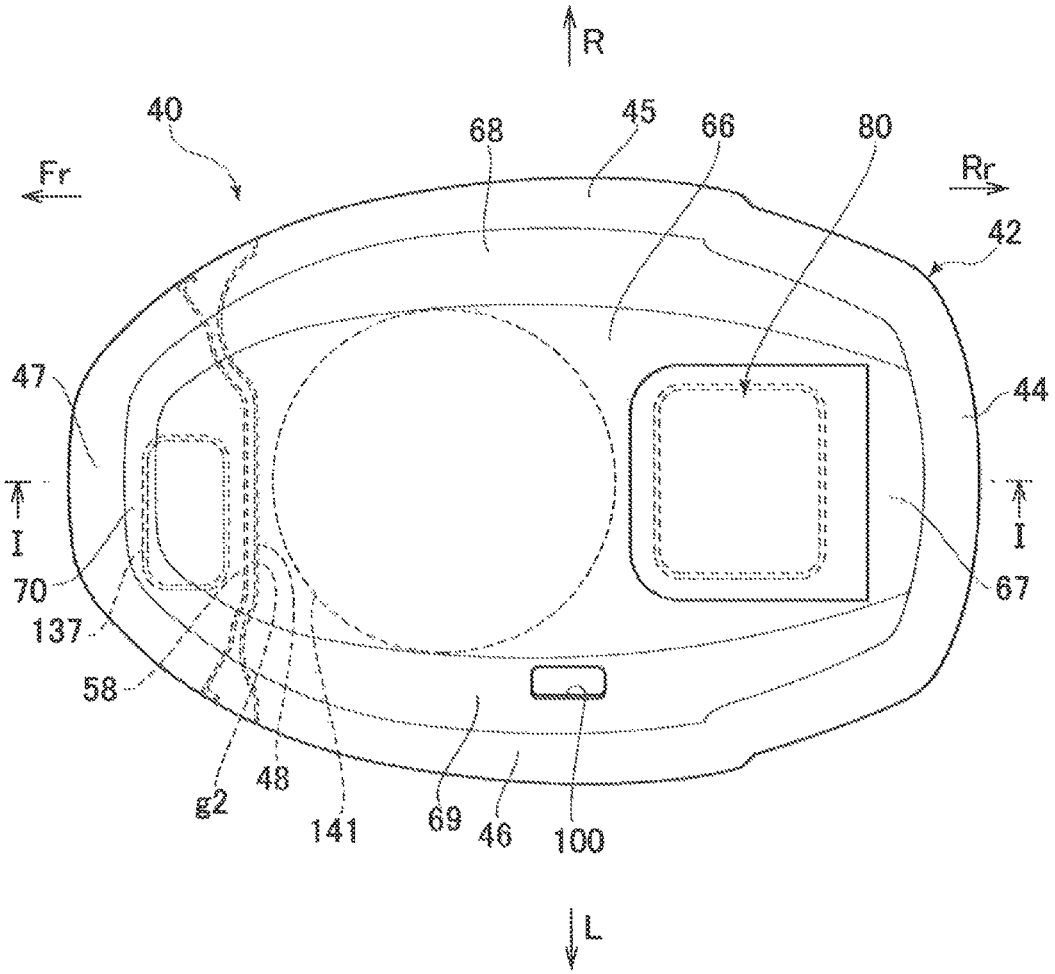
FIG. 2 is a plan view of the outboard motor.
Figure 3:
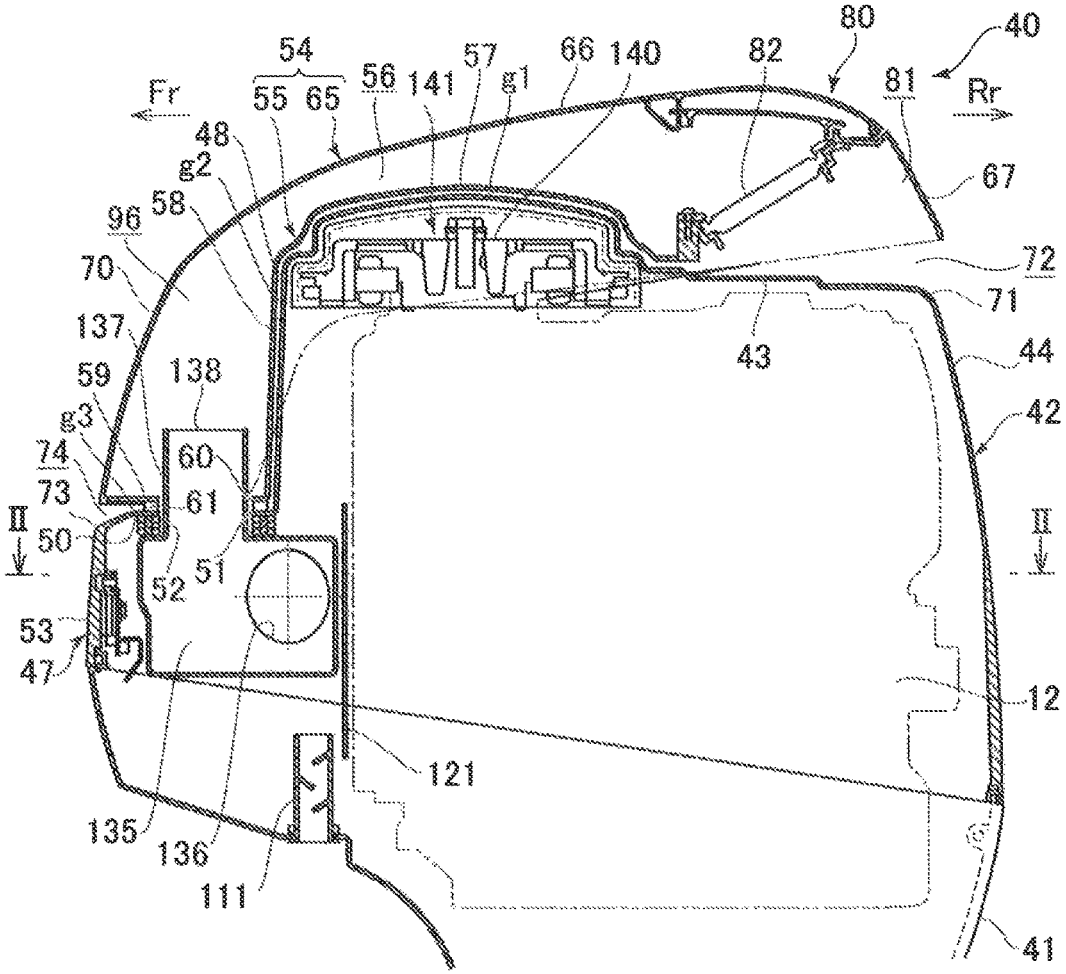
FIG. 3 is a left side cross-sectional view of the outboard motor.
Figure 4:
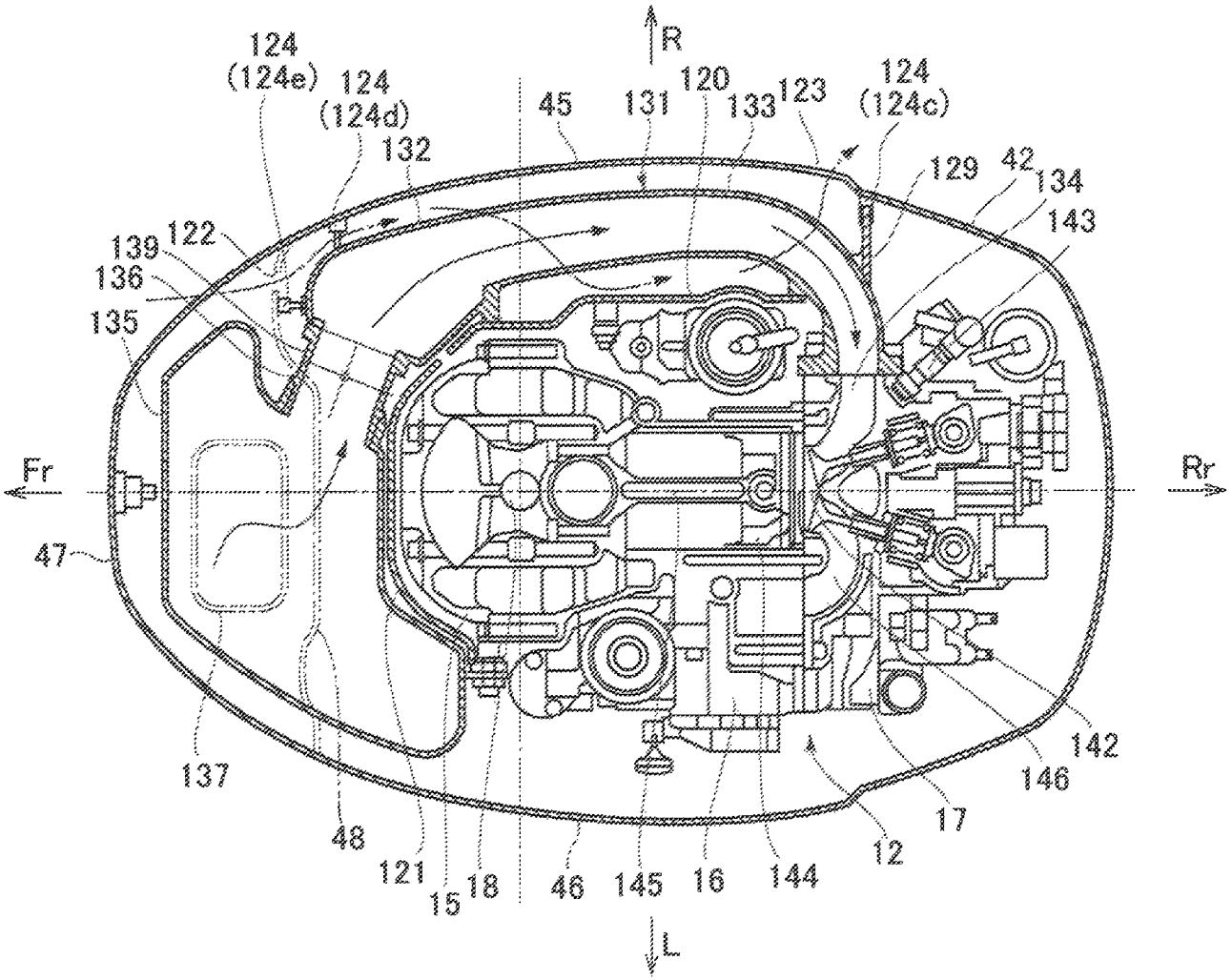
FIG. 4 is a cross-sectional view taken along a line II-II illustrated in FIG. 3.

Next, an upper cover 40 will be described with reference to FIG. 2 to FIG. 4. FIG. 2 is a plan view of the outboard motor 10. FIG. 3 is a cross-sectional view taken along a line I-I illustrated in FIG. 2 and seen from an arrow direction. FIG. 4 is a cross-sectional view taken along a line II-II illustrated in FIG. 3 and seen from an arrow direction.

As illustrated in FIG. 3, the upper cover 40 of this embodiment has an engine cover 42 covering the surrounding of an upper part of the engine 12, and an intake duct 54 disposed to cover an upper side of the engine cover 42 and a partly front side of the engine cover 42.

The engine cover 42 is formed so as to cover the engine 12 and an intake manifold 131 (see FIG. 4), a silencer 135, a throttle body 139 (see FIG. 4), a power generating device 140 (see FIG. 3), and so on, which are disposed around the engine 12. Here, as illustrated in FIG. 4, the intake manifold 131 is coupled to an intake port 134 disposed on a right side surface of the cylinder head 17, and is formed to pass the right side of the engine 12 and curved toward the front side. Between the intake manifold 131 and the engine 12, a first heat insulating member 120 made of synthetic resin material is disposed.

The silencer 135 is disposed on the front side of the engine 12 and at a substantially center in the vertical direction of the engine 12, and is fixed to the crank case 15. Between the silencer 135 and the front surface of the crank case 15, a second heat insulating member 121 made of synthetic resin along the vertical direction and a left and right direction is disposed. The silencer 135 is of the size having a vertical dimension that comes within a vertical dimension of the engine 12, and is formed so that its width dimension (left and right direction) becomes smaller with distance toward the front side. On a right side surface of the silencer 135, an opening part 136 to which the throttle body 139 is connected is formed. As illustrated in FIG. 3, the opening part 136 is located on a higher side than a lower surface of the silencer 135, and prevents water which entered the silencer 135 together with intake air from flowing into the throttle body 139 from the opening part 136. Further, on an upper surface of the silencer 135, a suction part 137 for sucking the intake air from an intake duct 54 is formed to project on an upper side.

The throttle body 139 is disposed on an obliquely front right side of the engine 12 and between the intake manifold 131 and the silencer 135. The throttle body 139 adjusts the amount of intake air to be admitted into the intake manifold 131 by opening and closing a not-illustrated throttle valve.

The power generating device 140 is disposed on an upper side of the engine 12 so that a part thereof projects forward from a front end of the engine 12. In this embodiment, a ventilation fan 141 of a centrifugal fan structure is constituted of a flywheel and a flywheel cover of the power generating device 140. The ventilation fan 141 rotates in conjunction with the crank shaft 18, and ventilates air inside the engine cover 42 which is heated by heat radiation from the engine 12, the power generating device 140, and the like.

The engine cover 42 will be described further. The engine cover 42 has an upper surface part 43, a rear surface part 44, a right side surface part 45, a left side surface part 46, and a front surface part 47. In the engine cover 42, the rear surface part 44, the right side surface part 45, the left side surface part 46, and part of the front surface part 47 are exterior surfaces of the outboard motor 10 and are formed to have a gradually curved shape.

The upper surface part 43 is formed so that its front section curves along an upper surface shape of the ventilation fan 141, and its rear section is flat along the shape of the engine 12 at a lower position than the front section.

The front surface part 47 has a first front plate 48 formed vertically downward from a front end of the upper surface part 43, a horizontal plate 50 formed horizontally forward from a lower end of the first front plate 48, and a second front plate 53 formed vertically downward from a front end of the horizontal plate 50.

The first front plate 48 is formed to have a space between itself and the engine 12 by the amount that the ventilation fan 141 is disposed to project from the front end of the engine 12.

The horizontal plate 50 is located at a substantially center in the vertical direction of the engine 12 and on a higher side than an upper surface of the silencer 135. In this embodiment, as illustrated in FIG. 3, part of the horizontal plate 50 is disposed to vertically overlap with part of the upper surface of the silencer 135. In the horizontal plate 50, an opening part 51 having a substantially rectangular shape is formed for inserting the suction part 137 of the silencer 135 upward. On a circumferential edge of the opening part 51 and between a lower surface of the horizontal plate 50 and the upper surface of the silencer 135, a sealing member 52 is attached surrounding the suction part 137 of the silencer 135, preventing entrance of water to the inside of the engine cover 42. The second front plate 53 is disposed separately from a front end of the silencer 135.

The intake duct 54 is constructed to form an intake passage 56 inside by an inner cover 55 disposed outside the engine cover 42 and a top cover 65 covering the inner cover 55 from the outside, which are integrally coupled by bonding or the like.

The inner cover 55 has a first bottom plate 57 formed along the shape of the upper surface part 43 of the engine cover 42, an inside front plate 58 formed vertically downward from a front end of the first bottom plate 57, and a second bottom plate 59 formed forward from a lower end of the inside front plate 58.

The first bottom plate 57 is formed substantially in parallel with the upper surface part 43 via a gap g1 from the upper surface part 43 of the engine cover 42. Note that the first bottom plate 57 does not reach a rear end of the upper surface part 43 of the engine cover 42 and covers the front section of the upper surface part 43. The inside front plate 58 is formed substantially in parallel with the first front plate 48 via a gap g2 from the first front plate 48 of the engine cover 42. Further, the second bottom plate 59 is formed substantially in parallel with the horizontal plate 50 via a gap g3 from the horizontal plate 50 of the engine cover 42. In the second bottom plate 59, an opening part 60 is formed for inserting the suction part 137 of the silencer 135 into the intake duct 54. Here, a suction port 138 of the silencer 135 is located on a higher side than a lower surface (second bottom plate 59) of the intake duct 54, and prevents water which entered the intake duct 54 together with intake air from flowing into the silencer 135. Further, between a lower surface of the second bottom plate 59 and an upper surface of the horizontal plate 50, a sealing member 61 is attached surrounding the suction part 137, preventing entrance of water to the inside of the intake duct 54 and the engine cover 42.

The top cover 65 has an upper surface part 66, a rear surface part 67, a right side surface part 68, a left side surface part 69, and a front surface part 70, and is formed in a gradually curved shape as an exterior surface.

The upper surface part 66 is formed so that its front section covers the first bottom plate 57 of the inner cover 55, and is formed to slope downward with distance toward the front side. On the other hand, a rear section of the upper surface part 66 is formed to cover the upper surface part 43 of the engine cover 42, slope upward with distance toward the rear side, slope downward thereafter, and continue to the rear surface part 67. On a rear section of the upper surface part 66, an openable/closable lid 80 is provided.

The rear surface part 67 is formed to slope downward. A rear end of the rear surface part 67 is located separately on an upper side from a boundary section 71 between the upper surface part 43 of the engine cover 42 and the rear surface part 44 of the engine cover 42. The space between the rear end of the rear surface part 67 and the boundary section 71 constitutes an outside air introduction port 72 for introducing outside air as intake air into the intake passage 56. When seeing the entire outboard motor 10, the outside air introduction port 72 is disposed in an upper section and a rear section of the outboard motor 10.

The right side surface part 68 and the left side surface part 69 are formed to cover the inner cover 55 from right and left, respectively. Lower ends of the right side surface part 68 and the left side surface part 69 are formed substantially in parallel with the shapes of the upper surface part 66 and the front surface part 70. The lower ends of rear sections of the right side surface part 68 and the left side surface part 69 slope upward so as to separate from the engine cover 42 with distance toward the rear side and are connected to a rear end of the rear surface part 67.

Further, as illustrated in FIG. 1 and FIG. 2, an exhaust port 100 is formed in the left side surface part 69 to face the outside. The ventilation fan 141 exhausts the air inside the engine cover 42 via the exhaust port 100.

The front surface part 70 is formed to cover the inside front plate 58 of the inner cover 55 from the front side, and is connected to a front end of the second bottom plate 59 of the inner cover 55. The front surface part 70 slopes downward continuously from the upper surface part 66, and its front end is located slightly separately on an upper side from a boundary section 73 of the horizontal plate 50 of the engine cover 42 and the second front plate 53. The space between the front end of the front surface part 70 and the boundary section 73 constitutes a traveling air introduction port 74 for introducing traveling air into the gap g3. The traveling air introduced via the traveling air introduction port 74 passes through the gap g3, the gap g2, and the gap g1 and flows out to the outside via the outside air introduction port 72.

In the intake duct 54 constituted thus, outside air is introduced via the outside air introduction port 72, and intake air is made to flow into the silencer 135 via the intake passage 56 in which an air filter 82 is disposed. Note that the intake duct 54 is coupled so as to cover the upper side and part of the front side of the engine cover 42 by fixing the top cover 65 to the engine cover 42 at plural positions with not-illustrated fixing screws or the like. Therefore, by disengaging the engine cover 42 from the lower cover 41, the intake duct 54 can also be disengaged together with the engine cover 42, thereby enabling to easily perform inspection of the engine 12 and so on.

Figure 5A:
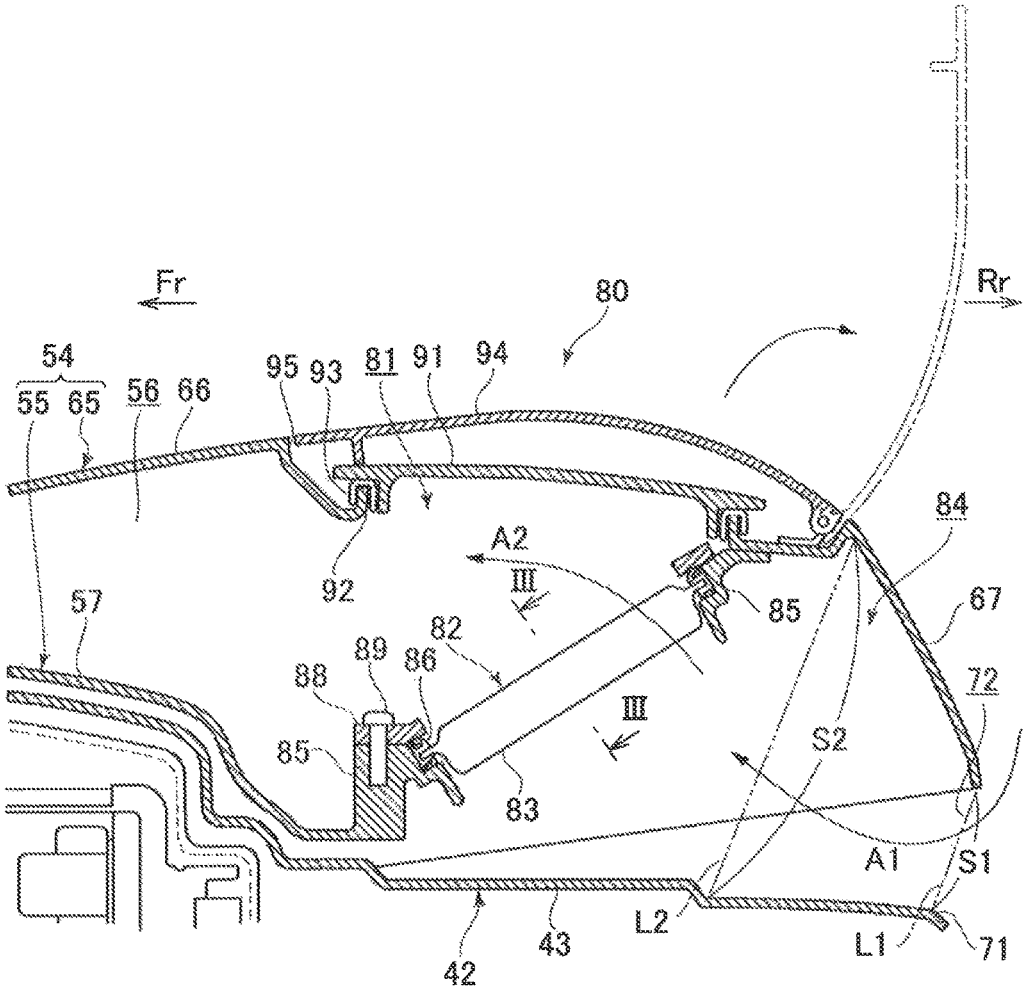
FIG. 5A is a partially enlarged view of an intake duct.
Figure 5B:
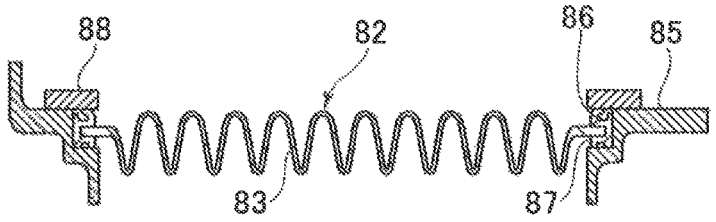
FIG. 5B is a cross-sectional view taken along a line III-III illustrated in FIG. 5A.

Next, the structure of the intake duct 54 will be described with reference to FIG. 3, FIG. 5A, and FIG. 5B. FIG. 5A is a partially enlarged view of FIG. 3, and FIG. 5B is a cross-sectional view taken along a line III-III of FIG. 5A.

Since the intake duct 54 is constituted of the inner cover 55 and the top cover 65, the degree of freedom of designing the intake passage 56 can be improved. Here, the intake passage 56 itself has a water separating function separating water from intake air. Specifically, in the top cover 65, the upper surface part 66 slopes upward with distance toward the rear side, and the first bottom plate 57 of the inner cover 55 slopes downward with distance toward the rear side. Therefore, a large space 81 is formed in a rear section of the intake passage 56.

In the space 81, the air filter 82 is disposed in the form of blocking the intake passage 56. The air filter 82 is disposed so that a suction surface 83 sucking intake air faces a lower side, more specifically, a rear obliquely lower side. The space on the upstream side from the air filter 82 in the space 81 constitutes a vapor/liquid separating chamber 84.

In the vapor/liquid separating chamber 84, at least a part of a cross-sectional area in the vapor/liquid separating chamber 84 is formed larger than the opening area of the outside air introduction port 72. For example, an opening dimension of the outside air introduction port 72, that is, the dimension of a virtual line L1 connecting a rear end of the rear surface part 67 of the top cover 65 and the boundary section 71 of the engine cover 42 is denoted by S1, and the dimension of a virtual line L2 in parallel with the virtual line L1 in the vapor/liquid separating chamber 84 immediately downstream of the outside air introduction port 72 is denoted by S2. At this time, the vapor/liquid separating chamber 84 is formed so that the distance S2 of the virtual line L2 is longer than the distance S1 of the straight line L1. That is, the vapor/liquid separating chamber 84 is formed to open in a widening manner in a vertical direction from the outside air introduction port 72 toward the downstream of the intake passage 56. Therefore, as illustrated by an arrow A1 in FIG. 5A, water which has entered together with intake air via the narrow outside air introduction port 72 decreases in flow rate by entering the wide vapor/liquid separating chamber 84. Water heavier in weight than the intake air drops by its own weight due to the decrease in flow rate. On the other hand, the intake air lighter in weight than water passes through the air filter 82 and flows in along the intake passage 56. Therefore, in the vapor/liquid separating chamber 84, the water can be separated efficiently from the intake air.

Further, as illustrated by an arrow A2 in FIG. 5A, the intake passage 56 is formed so that the intake air proceeds forward and upward when passing through the air filter 82 from the vapor/liquid separating chamber 84. Thus, by the intake passage 56 formed to be directed at least upward, water entered together with the intake air decreases in flow rate by gravity. Furthermore, since the air filter 82 is disposed in middle of the intake passage 56 directed upward, and the suction surface 83 faces the lower side, passage of water which decreased in flow rate can be blocked easily. Therefore, in the intake passage 56 in the space 81, water can be separated efficiently from the intake air. The water separated from the intake air drops down to the upper surface part 43 of the engine cover 42, and thereafter drained to the outside of the outboard motor 10.

Thus, the intake duct 54 can freely form the intake passage 56 without being restricted by the engine cover 42 by being disposed outside the engine cover 42. Particularly, since the intake duct 54 forms the intake passage 56 with the top cover 65 and the inner cover 55, the vapor/liquid separating chamber 84 opened in a widening manner from the outside air introduction port 72 and the complicated intake passage 56 in which intake air proceeds at least upward can be formed easily.

Further, in the intake duct 54, the air filter 82 is disposed so as to allow performing maintenance such as inspection and replacement. Specifically, the air filter 82 is attached detachably to an attachment part 85 disposed obliquely from the rear end of the inner cover 55 toward the rear end of the upper surface part 66 of the top cover 65. A rectangular opening 86 is formed in the attachment part 85, and the air filter 82 is fitted into an opening 86 from above via a sealing member 87 attached to the periphery of the air filter 82. The attachment part 85 has a holding plate 88 which presses down the sealing member 87 of the air filter 82 from above, so as to prevent the air filter 82 from being removed improperly. The pressing plate 88 is fixed to the attachment part 85 by a fixing screw 89 from above.

On an upper side of the air filter 82 and in the upper surface part 66 of the top cover 65, the above-described lid 80 is provided. The lid 80 of this embodiment is of double structure with a first lid member 91 and a second lid member 94 located on an upper side of the first lid member 91. The first lid member 91 blocks from above a first opening 92 which is stepped and recessed to a lower side from an upper surface of the top cover 65 and is formed along the vertical direction. When the first lid member 91 is opened, the first opening 92 is formed to have a size and at a position which allow recognition of the entire air filter 82. On an opening edge of the first opening 92, a sealing member 93 is attached. Therefore, in a state that the first lid member 91 blocks the first opening 92, entrance of water into the intake passage 56 from the outside of the top cover 65 is prevented by the sealing member 93.

Further, the second lid member 94 blocks from above a second opening 95 formed in the upper surface part 66 of the top cover 65. When the second lid member 94 is opened, the second opening 95 is formed to have a size and at a position which allow recognition of the opening edge of the first opening 92. Further, in a state that the second lid member 94 blocks the second opening 95, the second lid member 94 constitutes part of an exterior surface of the top cover 65. A rear end of the second lid member 94 opens and closes in the vertical direction by a hinge structure between itself and the top cover 65.

By opening the lid 80, the user can perform maintenance of the air filter 82 without removing and disassembling the upper cover 40. Specifically, first the user opens the second lid member 94 to thereby open the second opening 95. Next, the user opens the first opening 92 by detaching the first lid member 91 upward via the second opening 95. Therefore, the user can perform maintenance of the air filter 82 via the second opening 95 and the first opening 92.

Salt of sea water or trash attempted to pass through together with intake air may adhere to the suction surface 83 of the air filter 82. In this case, the filtration area of the air filter 82 decreases, which increases suction resistance and results in decrease of output of the engine 12. Thus, the user needs to clean or replace the air filter 82. At this time, as described above, the user can easily perform maintenance of the air filter 82 via the second opening 95 and the first opening 92 without removing and disassembling the engine cover 42.

For example, when small pieces of trash adhere to the suction surface 83 of the air filter 82, it is possible to clean the air filter 82 by blowing compressed air toward the air filter 82 from above via the second opening 95 and the first opening 92. At this time, since the suction surface 83 of the air filter 82 faces the lower side, the trash adhering to the suction surface 83 can be dropped downward.

Further, when replacing the air filter 82, the fastening screw 89 is loosened via the second opening 95 and the first opening 92 and the holding plate 88 is removed from the attachment part 85, and then the air filter 82 is removed from the opening 86, thereby allowing replacement of the air filter 82.

Note that as illustrated in FIG. 5B, the air filter 82 is formed in a folded form which is folded back plural times. Therefore, the suction surface 83 of the air filter 82 can ensure a large filtration area, and the intake resistance when the intake air passes through the air filter 82 can be decreased. As the air filter 82, for example, a water repellent element, a water repellent air filter, or the like can be used.

In the intake duct 54 structured as described above, the intake air introduced into the vapor/liquid separating chamber 84 of the space 81 from the outside air introduction port 72 passes through the air filter 82 in a state that water is separated by the vapor/liquid separating chamber 84 and the intake passage 56. The intake air which passed through the air filter 82 passes through the space which is vertically narrow in the intake passage 56 formed between the front section of the upper surface part 66 of the top cover 65 and a front part of the first bottom plate 57 of the inner cover 55, and then flows into the front side. The intake air which flowed into the front side flows into a large space 96 in the intake passage 56 formed between the front surface part 70 of the top cover 65 and the inside front plate 58 of the inner cover 55. The intake air which flowed into the space 96 passes through the suction port 138 and then flows into the silencer 135. At this time, even when water is included in the intake air, since the suction port 138 of the silencer 135 is located on the higher side than the lower surface of the intake duct 54, water just stays in the intake duct 54, preventing the water from entering the silencer 135 through the suction port 138.

Further, the intake duct 54 is disposed via the gap g1 to gap g3 from the engine cover 42. These gap g1 to gap g3 have the function of air jacket. Therefore, the intake air flowing through the intake passage 56 of the intake duct 54 flows into the silencer 135 in a state that heat from the engine cover 42 is blocked. Further, in this embodiment, the traveling air introduced via the traveling air introduction port 74 flows into the gap g1 to gap g3. Therefore, intake air flowing through the intake passage 56 is cooled by the traveling air, allowing cooled intake air to flow into the silencer 135.

The intake air which flowed into the silencer 135 flows into the throttle body 139 via the opening part 136. At this time, even when water is contained in the intake air, since the opening part 136 is located on the higher side than the lower surface of the silencer 135, the water just stays in the silencer 135, preventing the water from entering the throttle body 139 via the opening part 136. The intake air which flowed into the throttle body 139 flows from the intake manifold 131 through the intake port 134 into a combustion chamber 142 formed between the cylinder block 16 and the cylinder head 17. At this time, an air-fuel mixture is generated by jetting fuel from a fuel injector 143, and the air-fuel mixture is combusted in the combustion chamber 142. By combustion of the air-fuel mixture, a piston 144 reciprocates in a forward and backward direction, rotating the crank shaft 18 via a connecting rod 145. Exhaust gas combusted in the combustion chamber 142 is exhausted via an exhaust port 146.

Further, in the intake duct 54, by being formed of the top cover 65 and the inner cover 55, the intake passage 56 in which the volumes of the large spaces 81, 96, and so on are varied can be formed easily. By making the intake air flow into such spaces 81, 96 varied in volume, suction noise can be attenuated.

Figure 6:
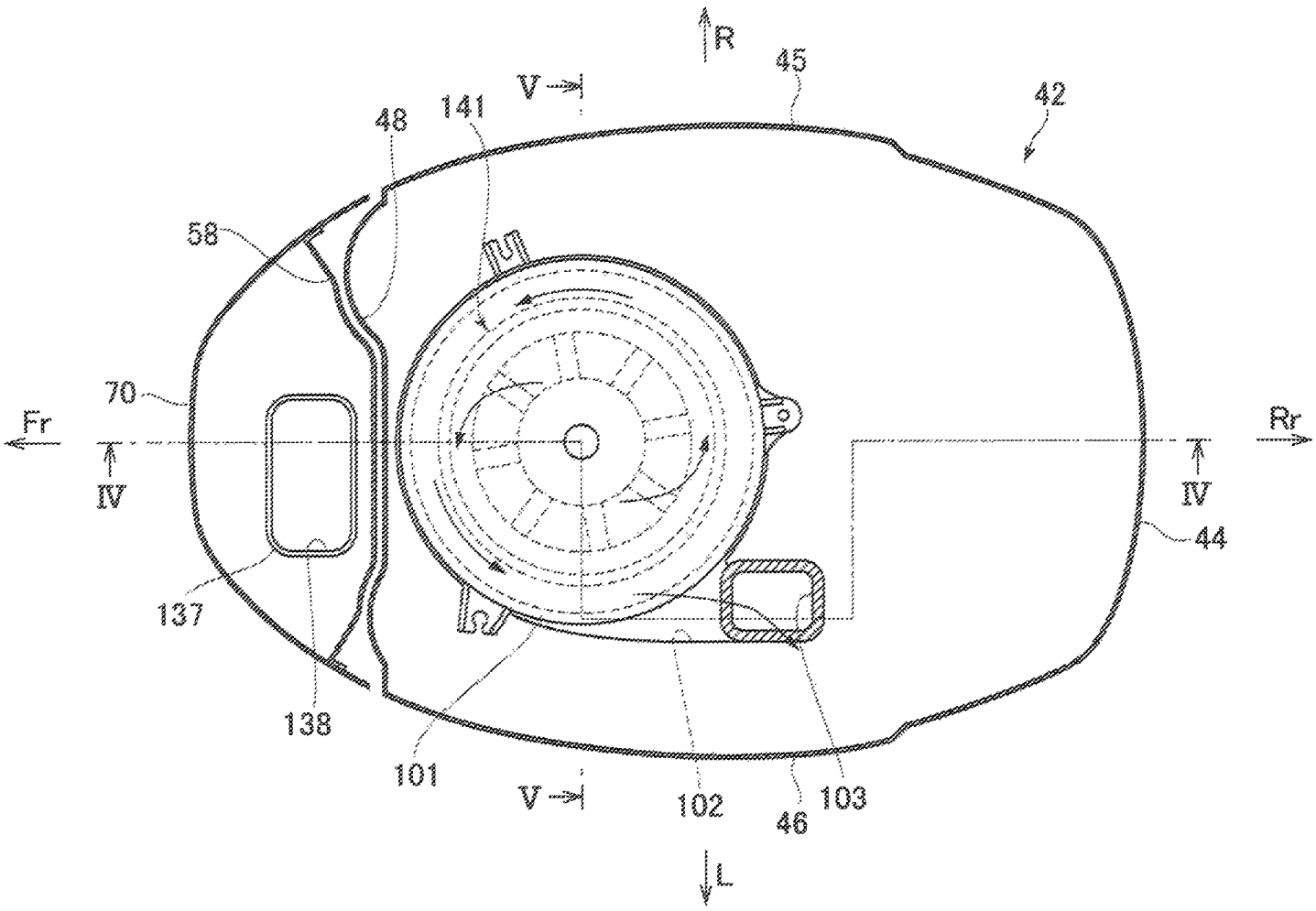
FIG. 6 is a cross-sectional view in which a ventilation fan in an engine cover is seen from an upper side.
Figure 7:
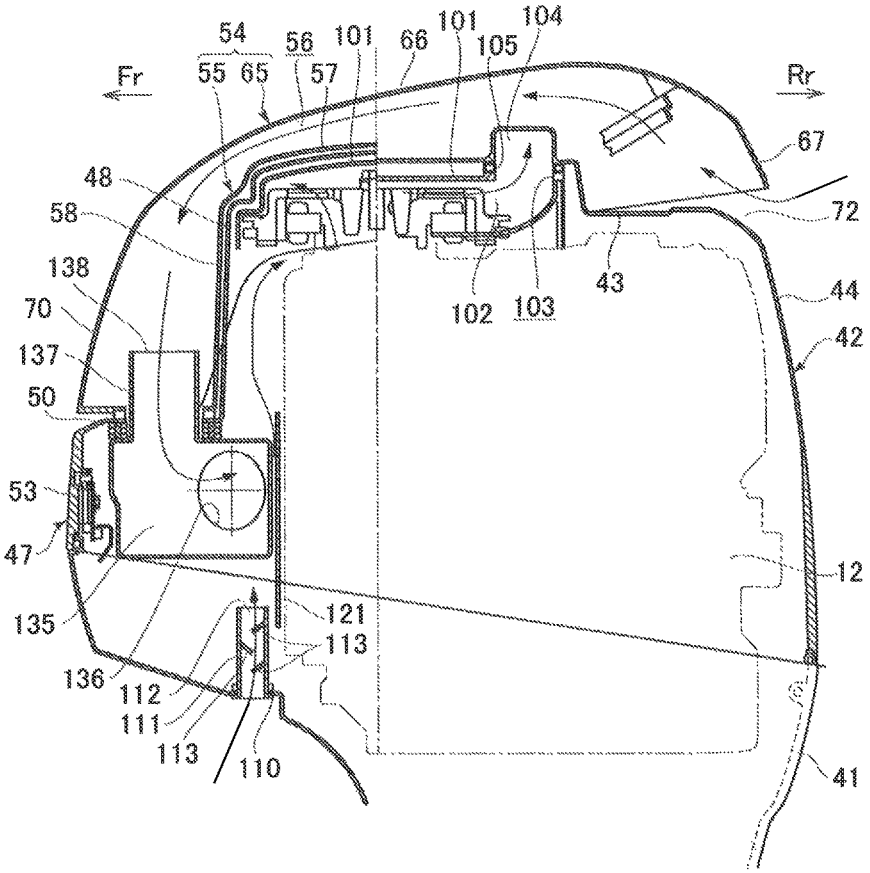
FIG. 7 is a cross-sectional view taken along a line IV-IV illustrated in FIG. 6.
Figure 8:
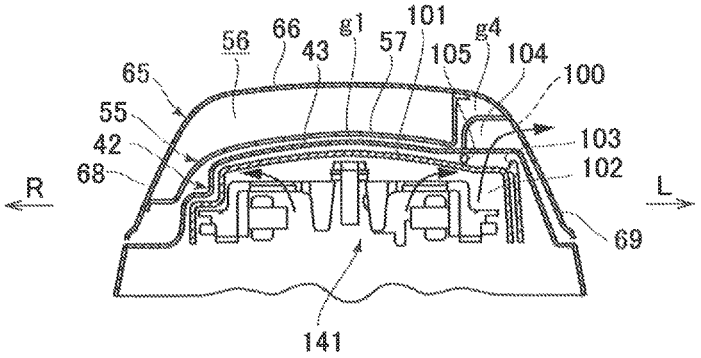
FIG. 8 is a cross-sectional view taken along a line V-V illustrated in FIG. 6.

Next, the structure for ventilating the inside of the engine cover 42 will be described with reference to FIG. 6 to FIG. 8. FIG. 6 is a cross-sectional view in which the ventilation fan 141 in the engine cover 42 is seen from above. FIG. 7 is a cross-sectional view taken along a line IV-IV illustrated in FIG. 6 and seen from an arrow direction. FIG. 8 is a cross-sectional view taken along a line V-V illustrated in FIG. 6 and seen from an arrow direction.

The ventilation fan 141 of this embodiment ventilates air in the engine cover 42 by exhausting hot air in the engine cover 42 and taking in air by the exhausted amount.

First, the structure for exhausting the air inside the engine cover 42 will be described.

As illustrated in FIG. 6 and FIG. 7, the ventilation fan 141 is covered from above by a fan cover 101. In part of the fan cover 101, a first exhaust passage 102 for exhausting air in the engine cover 42 sucked up by the ventilation fan 141 is formed. As illustrated in FIG. 6, the first exhaust passage 102 extends out to the rear side along a tangent line of an outer periphery from a left side part of the fan cover 101, and is formed until reaching a rear end of the ventilation fan 141. In a rear end of the first exhaust passage 102, an opening part 103 opening upward is formed.

As illustrated in FIG. 8, on the upper surface part 43 of the engine cover 42, a second exhaust passage 104 communicating with the first exhaust passage 102 is formed. The second exhaust passage 104 is bent leftward after it extends out to the upper side through the opening part 103. As illustrated in FIG. 7, between an upper surface of the fan cover 101 and a lower surface of the engine cover 42, a sealing member 105 is attached so as to surround the opening part 103, preventing entrance of water into the engine cover 42 from the opening part 103.

Figure 9:
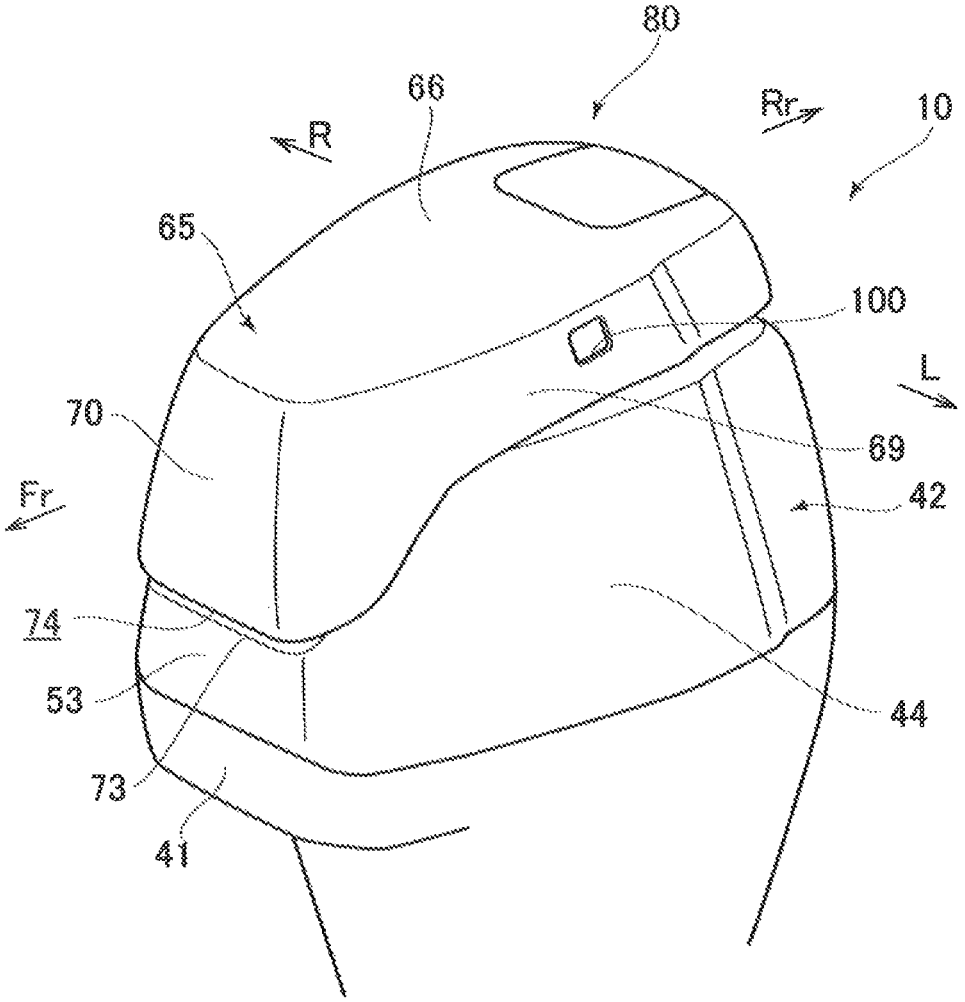
FIG. 9 is a perspective view of the outboard motor seen from an obliquely front side.

As illustrated in FIG. 8, at a position where the second exhaust passage 104 is bent leftward, the exhaust port 100 formed in the top cover 65 is located and communicates with the second exhaust passage 104. FIG. 9 is a perspective view of the outboard motor 10 seen from an obliquely front side. As illustrated in FIG. 9, the exhaust port 100 is formed in the left side surface part 69 of the top cover 65, and air in the engine cover 42 is exhausted to the outside through the first exhaust passage 102 and the second exhaust passage 104 and via the exhaust port 100.

Further, as illustrated in FIG. 8, in a portion where the second exhaust passage 104 is formed, the inner cover 55 is formed to be biased to a center side in the width direction of the intake passage 56 so as not to interfere with the second exhaust passage 104. Therefore, in the vicinity of the second exhaust passage 104, a gap g4 is formed between an engine cover 42 and the inner cover 55. The gap g4 communicates with the gap g1 formed between the first bottom plate 57 of the above-described inner cover 55 and the upper surface part 43 of the engine cover 42. Therefore, traveling air flows into the gap g4 similarly to the gap g1, and can cool intake air flowing through the intake passage 56.

Next, the structure to take in air into the engine cover 42 will be described.

As illustrated in FIG. 7, a take-in port 110 is formed in a lower surface of the front side of the lower cover 41. To the take-in port 110, a take-in part 111 for taking fresh air into the engine cover 42 is attached. The take-in part 111 projects toward the upper side of the engine cover 42 from the take-in port 110. In the take-in part 111, a take-in passage 112 along the vertical direction is formed, and a plurality of water shielding members 113 preventing entrance of water into the engine cover 42 are formed to project on an inner peripheral surface of the take-in passage 112. The water shielding members 113 are separated vertically and project from front and rear alternately. The water shielding members 113 are oriented downward with distance from an inner circumferential surface toward a tip. Therefore, water which entered the take-in part 111 from the take-in port 110 is blocked from entering by the water shielding members 113, drops along the water shielding members 113, and is drained to the outside. On the other hand, the outside air passes through the water shielding members 113 and is taken into the engine cover 42 along the take-in passage 112.

In the ventilation structure as described above, by rotation of the ventilation fan 141, hot air in the engine cover 42 is sucked up from a lower side of the ventilation fan 141. The sucked up air flows into the first exhaust passage 102 formed along the tangent line of the outer periphery of the fan cover 101 by flowing along a rotation direction of the ventilation fan 141. The air which flowed into the first exhaust passage 102 flows into the second exhaust passage 104 via the opening part 103, and is thereafter exhausted to the outside via the exhaust port 100 formed in the left side surface part 69 of the top cover 65.

On the other hand, the outside air flows into the engine cover 42 via the take-in part 111 by the amount of air exhausted by the ventilation fan 141. The outside air which flowed into the take-in part 111 fills around the engine 12 and the silencer 135 to ventilate there, and the engine 12 and so on can be cooled by this. Further, part of outside air which flowed via the take-in part 111 fills the lower side of the ventilation fan 141 and so on while absorbing heat when passing through the space between the silencer 135 and the second heat insulating member 121. Thereafter, ventilation continues by being sucked up by the ventilation fan 141 and exhausting to the outside. By ventilating the air in the engine cover 42, overheating in the engine cover 42 can be prevented. Therefore, the operating functions of the parts in the engine cover 42 can be maintained stably and normally, thereby assuring long durability of the parts.

Figure 10:
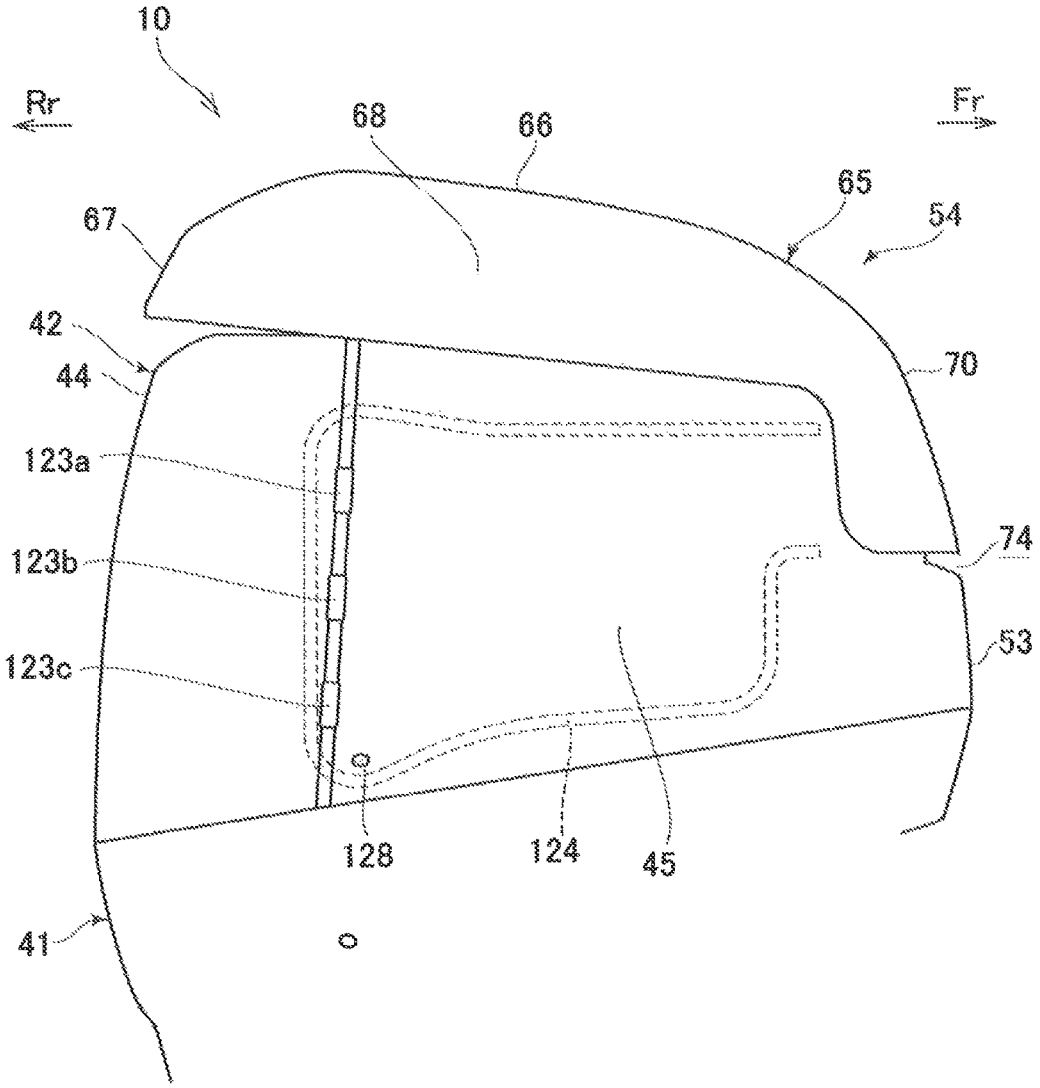
FIG. 10 is a right side view of the outboard motor.
Figure 11:
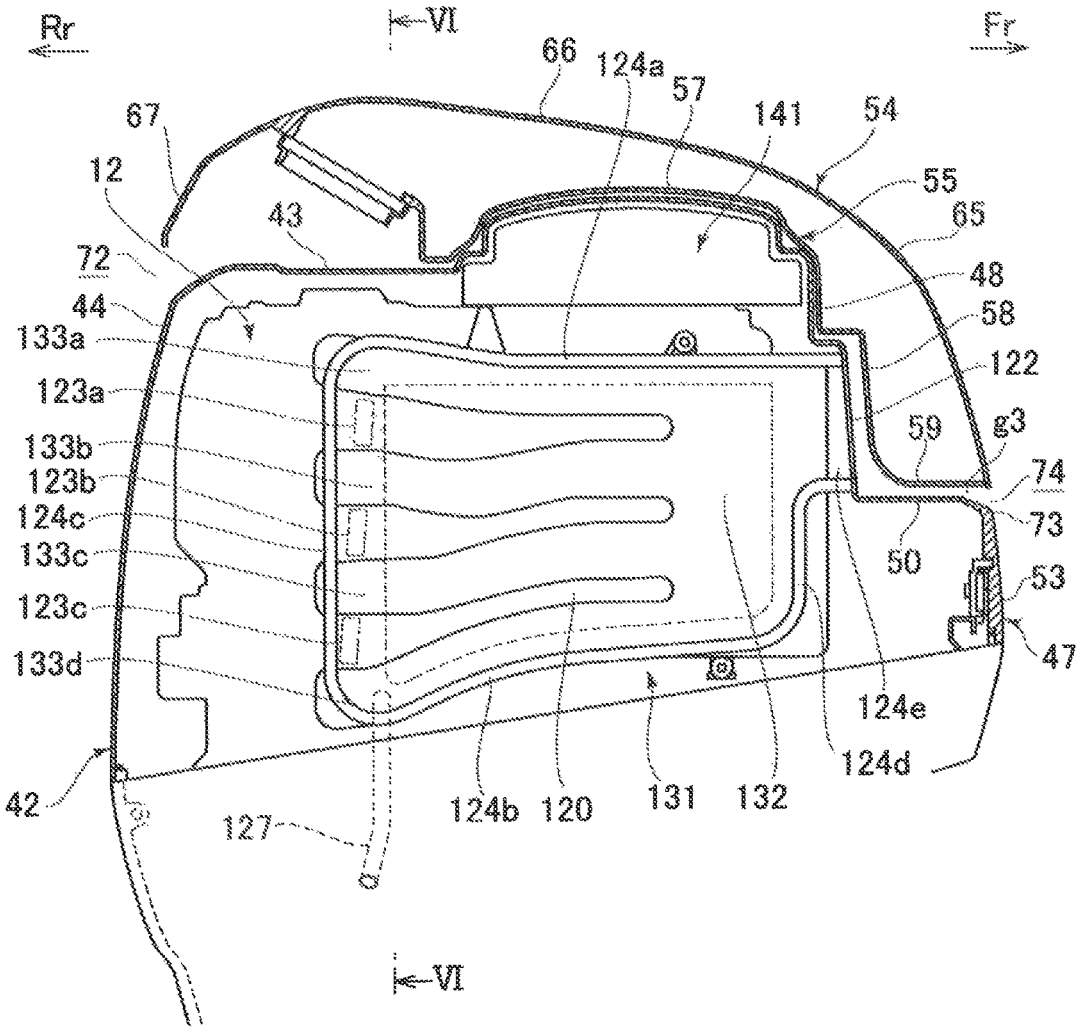
FIG. 11 is a right cross-sectional view of the outboard motor.
Figure 12:
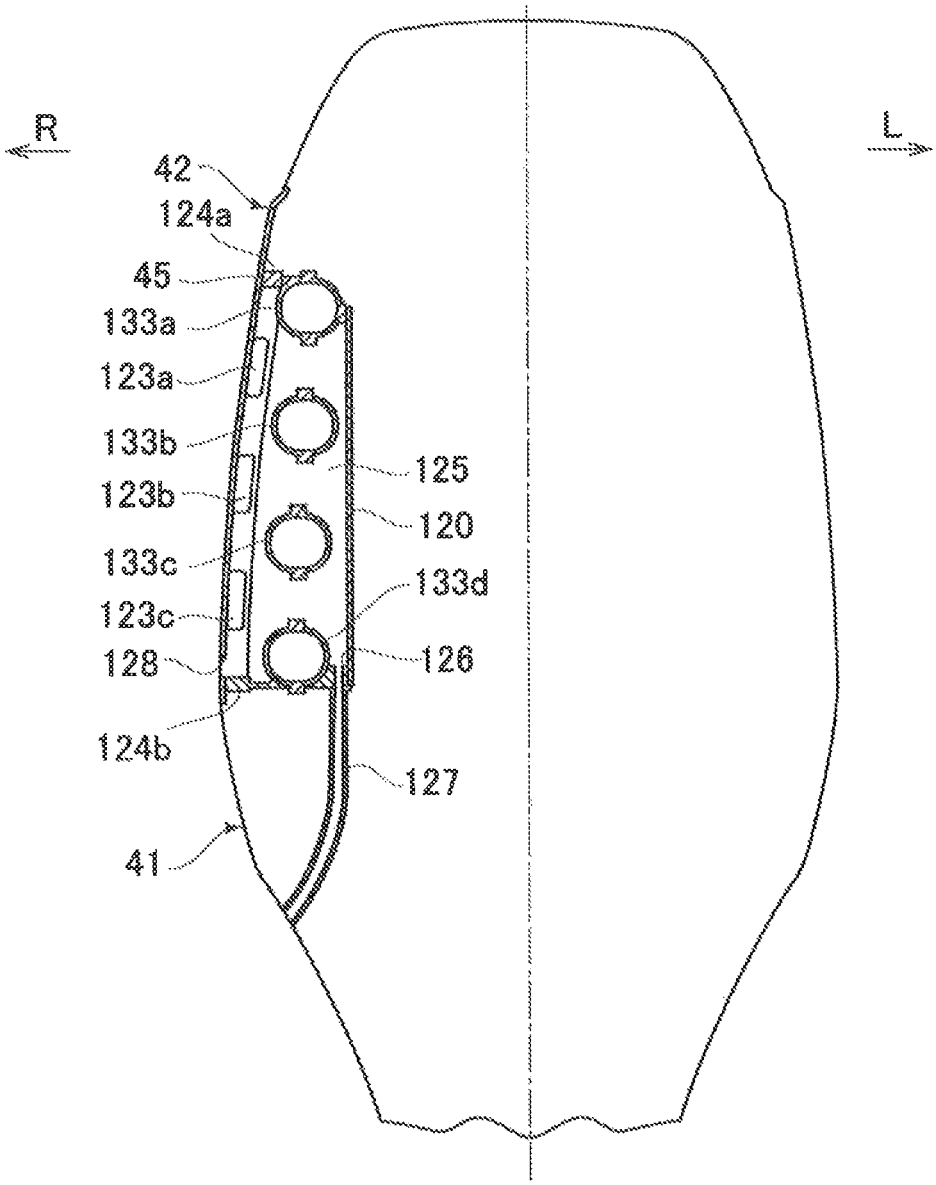
FIG. 12 is a cross-sectional view taken along a line VI-VI illustrated in FIG. 11.

Next, the structure for cooling the intake manifold 131 will be described with reference to FIG. 10 to FIG. 12. FIG. 10 is a right side view of the outboard motor 10. FIG. 11 is a right cross-sectional view of the outboard motor 10. FIG. 12 is a cross-sectional view of a line VI-VI illustrated in FIG. 11 seen from an arrow direction.

As illustrated in FIG. 11, the intake manifold 131 is formed by, for example, melt-bonding a synthetic resin and has a surge tank 132 and a first intake branch pipe 133*a* to a fourth intake branch pipe 133*d* which are coupled to the surge tank 132.

The surge tank 132 is formed along the vertical direction on an obliquely front right side of the engine 12. The throttle body 139 is coupled to the upstream side of the surge tank 132, and the first intake branch pipe 133*a* to the fourth intake branch pipe 133*d* are coupled to the downstream side. In this embodiment, the first intake branch pipe 133*a* to the fourth intake branch pipe 133*d* are disposed in parallel in a state of being vertically separated. The first intake branch pipe 133*a* to the fourth intake branch pipe 133*d* extend out toward the rear side from the surge tank 132, and thereafter curve leftward and coupled to the intake port 134.

On a left side surface of the intake manifold 131, the first heat insulating member 120 for insulating heat radiation from the engine 12 is coupled with a fixing screw, by bonding, or the like. Specifically, as illustrated in FIG. 12, in the first heat insulating member 120, an upper part is fixed to a left side surface of the first intake branch pipe 133*a*, and a lower part is fixed to a left side surface of the fourth intake branch pipe 133*d*. Therefore, gaps are formed between the first heat insulating member 120, the second intake branch pipe 133*b*, and the third intake branch pipe 133*c*. As illustrated in FIG. 4, the first heat insulating member 120 is formed to extend out in a forward and backward direction, and its front part reaches an inside and front part of the surge tank 132. At a position adjacent to the first heat insulating member 120, the second heat insulating member 121 for insulating heat radiation from the engine to the silencer 135 is disposed. Note that the first heat insulating member 120 and the second heat insulating member 121 may be continuously formed integrally.

As illustrated in FIG. 4 and FIG. 11, on the right end part of the first front plate 48 of the engine cover 42, an inflow port 122 for allowing inflow of traveling air into the engine cover 42 is formed. The traveling air which flowed in via the inflow port 122 is part of traveling air introduced from the above-described traveling air introduction port 74. Note that in FIG. 4, the first front plate 48 and the inflow port 122 are illustrated by two-dot chain lines. The traveling air which flowed in via the inflow port 122 passes through the space between the inside surface of the right side surface part 45 of the engine cover 42 and the outside surface of the surge tank 132, and flows toward the rear side while contacting the outside surfaces of the first intake branch pipe 133*a* to the fourth intake branch pipe 133*d*.

As illustrated in FIG. 10 and FIG. 11, on the right side surface part 45 of the engine cover 42, a first discharge port 123*a* to a third discharge port 123*c* for discharging traveling air which flowed into the engine cover 42 are formed. In this embodiment, the first discharge port 123*a* to the third discharge port 123*c* are formed in parallel in a state of being vertically separated. Specifically, as illustrated in FIG. 11 and FIG. 12, when seen from the right side, the first discharge port 123*a* to the third discharge port 123*c* are formed between the first intake branch pipe 133*a* to the fourth intake branch pipe 133*d*, respectively. That is, the first discharge port 123*a* to the third discharge port 123*c* are formed at positions where traveling air flowing into spaces among the first intake branch pipe 133*a* to the fourth intake branch pipe 133*d* can be discharged to the outside easily. Note that in FIG. 11, the first discharge port 123*a* to the third discharge port 123*c* are illustrated with two-dot chain lines.

Further, as illustrated in FIG. 11, on the right side surface of the intake manifold 131, a sealing member 124 (124*a* to 124*e*) is attached along a substantial contour surrounding the intake manifold 131. Specifically, an upper sealing member 124*a* is coupled to an outside surface of the first intake branch pipe 133*a* and an outside surface of the surge tank 132 (see also FIG. 12). Further, a lower sealing member 124*b* is coupled to an outside surface of the fourth intake branch pipe 133*d* and the outside surface of the surge tank 132 (see also FIG. 12). Further, as illustrated in FIG. 4, a rear sealing member 124*c* is coupled to an extending-out part 129 extending rightward from the first intake branch pipe 133*a* to the fourth intake branch pipe 133*d*. Further, as illustrated in FIG. 11, a sealing member 124*d* is coupled to outside surfaces of the front side and the lower side of the surge tank 132 (see also FIG. 4). Further, a sealing member 124*e* is coupled to outside surfaces of the front end and the upper side of the surge tank 132 (see also FIG. 4).

The sealing member 124*a* to the sealing member 124*d* are in close contact with an inside surface of the right side surface part 45 of the engine cover 42. Therefore, a space 125 surrounded by the sealing member 124*a* to the sealing member 124*d* is formed between the engine cover 42 and the first heat insulating member 121. This space 125 is blocked excluding the inflow port 122, the discharge ports 123, and drain ports 126, 128 which will be described later.

Further, the sealing member 124*e* causes traveling air flowed in via the inflow port 122 to flow into the intake manifold 131 side, and blocks its flow into the throttle body 139 side.

As illustrated in FIG. 12, a first drain port 126 is formed in a rear side of the space 125 and a lower part between the fourth intake branch pipe 133*d* and the first heat insulating member 120. To the first drain port 126, a drain pipe 127 is connected, and water which entered the space 125 is drained to the outside of the lower cover 41 from the drain pipe 127 through the first drain port 126. Further, as illustrated in FIG. 12, a second drain port 128 is formed in the rear side of the space 125 and the right side surface part 45 of the engine cover 42. Water which entered the space 125 is drained to the outside of the engine cover 42 via the second drain port 128.

In the above-described cooling structure, part of the traveling air introduced via the traveling air introduction port 74 flows into the intake manifold 131 via the inflow port 122 formed in the first front plate 48 of the engine cover. At this time, the space 125 between the engine cover 42 and the first heat insulating member 120 in which the intake manifold 131 is disposed is sealed with the sealing member 124. Therefore, traveling air which flowed in via the inflow port 122 can be efficiently brought into contact with the outside surface of the intake manifold 131, and intake air flowing in the intake manifold 131 can be cooled efficiently.

Further, since the first intake branch pipe 133*a* to the fourth intake branch pipe 133*d* of the intake manifold 131 are disposed vertically separately, areas where the intake manifold 131 and the traveling air are in contact can be secured largely, and intake air flowing in the intake manifold 131 can be cooled efficiently. The traveling air which cooled the intake manifold 131 and increased in temperature is exhausted to the outside of the engine cover 42 via the first discharge port 123*a* to the third discharge port 123*c*.

Further, even when water enters the space 125 together with traveling air, water splash onto the engine 12 can be prevented by the first heat insulating member 120. Further, water which entered the space 125 together with traveling air is drained to the outside by the first drain port 126 and the second drain port 128.

As described above, according to this embodiment, since the intake duct 54 is disposed outside the engine cover 42, as compared to the case where it is disposed in the engine cover, the complicated intake passage 56 can be formed without being restricted by the shape of the engine cover 42. Therefore, the intake structure which can separate water from intake air can be formed easily.

As described above, according to this embodiment, since the intake duct 54 is disposed via the gap g1 to gap g3 with the engine cover 42, intake air of the intake passage 56 is prevented from being heated by hot air in the engine cover 42. Further, since traveling air introduced via the traveling air introduction port 74 flows into the gap g1 to gap g3, intake air of the intake passage 56 can be cooled by the traveling air. Therefore, by cooling intake air, charging efficiency of intake air improves, and hence output of the engine 12 can be improved.

As described above, according to this embodiment, since traveling air flowed in via the inflow port 122 formed in the front surface part 47 of the engine cover 42 is brought into contact with the outside surface of the intake manifold 131 and is discharged via the first discharge port 123*a* to the third discharge port 123*c* formed in the right side surface part 68 of the engine cover 42, intake air of the intake manifold 131 can be cooled by the traveling air. Therefore, by cooling intake air, charging efficiency of intake air improves, and hence output of the engine 12 can be improved.

In the foregoing, the present invention has been described by the above-described embodiment, but the present invention is not limited only to the above-described embodiment. It is possible to make any change and/or the like within the range of the present invention.

In the above-described embodiment, the case where the lid 80 is of double structure with the first lid member 91 and the second lid member 94 is described, but it is not limited to this case. For example, the lid 80 may be only one of the first lid member 91 and the second lid member 94. When the lid 80 is constituted only of the second lid member 94, it is preferred to interpose a sealing member between the second lid member 94 and the second opening 95.

Further, in the above-described embodiment, the case where the exhaust port 100 is formed on the left side surface part 69 of the top cover 65 is described, but it is not limited to this case. For example, the exhaust port 100 may be formed in either one of the right side surface part 68 and the left side surface part 69 of the top cover 65. Note that when the exhaust port 100 is formed in the right side surface part 68 of the top cover 65, also the first exhaust passage 102 and the second exhaust passage 104 are preferably disposed on the right side of the outboard motor 10.

Further, in the above-described embodiment, the case where the intake manifold 131 is disposed between the right side surface part 45 of the engine cover 42 and the right side surface of the engine 12 is described, but it is not limited to this. For example, the intake manifold 131 may also be disposed between the left side surface part 46 of the engine cover 42 and the left side surface of the engine 12. Note that in this case, the inflow port 122, the discharge port 123, and so on are preferably disposed likewise on the left side of the engine cover 42.

Further, in the above-described embodiment, the case where the intake manifold 131 has four, first intake branch pipe 133*a* to fourth intake branch pipe 133*d* is described, but it is not limited to four intake branch pipes. The intake manifold may have one or more intake branch pipes. Further, the case where three, first discharge port 123*a* to third discharge port 123*c* are formed in the engine cover 42 is described, but one or more discharge ports may be formed.

According to the present invention, water can be separated efficiently from intake air.

Further, according to the present invention, increase in intake temperature is prevented, and charging efficiency of intake air can be improved.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An intake structure of an outboard motor supplying intake air to an internal combustion engine of the outboard motor, the intake structure comprising:

an engine cover housing, in an inside, the internal combustion engine of the outboard motor;

an inner cover disposed on an outside of the engine cover;

a top cover covering the inner cover; and a silencer supplying intake air to the internal combustion engine of the outboard motor, wherein the inner cover and the top cover form an intake duct supplying intake air to the internal combustion engine of the outboard motor, and wherein the intake duct disposed on an outside of the engine cover via a gap from the engine cover for an entire length of the intake duct, from an outside air introduction port introducing outside air into an intake passage in the intake duct to the silencer, and coupled to an intake port of the internal combustion engine of the outboard motor.

2. The intake structure of the outboard motor according to claim 1, wherein:

an area of the outside air introduction port is smaller than a cross-sectional area of a space formed in the intake passage immediately downstream of the outside air introduction port.

3. The intake structure of the outboard motor according to claim 2, further comprising an air filter in the intake passage, wherein a suction surface of the air filter is angled downward with respect to gravity.

4. The intake structure of the outboard motor according to claim 3, wherein the top cover has a lid which is disposed on an upper side of the air filter and is detachable.

5. The intake structure of the outboard motor according to claim 2, wherein intake air flows from the intake passage to the silencer, wherein a suction port of the silencer is located on a higher side than a lower surface of the intake passage.

6. The intake structure of the outboard motor according to claim 5, further comprising a throttle body in which intake air flows from the silencer, wherein an opening part of the silencer connected to the throttle body is located on a higher side than a lower surface of the silencer.

7. The intake structure of the outboard motor according to claim 1, wherein traveling air flows to the gap from a traveling air introduction port formed between the engine cover and the intake duct.

8. The intake structure of the outboard motor according to claim 7, wherein:

a ventilation fan exhausting air in the engine cover to an outside is provided in the engine cover; and the ventilation fan exhausts air in the engine cover to the outside via an exhaust port formed in the top cover through an exhaust passage formed in the engine cover.

9. The intake structure of the outboard motor according to claim 7, wherein the silencer is disposed in the engine cover and intake air flows from an intake passage in the intake duct, wherein a suction port of the silencer is located on a higher side than a lower surface of the intake passage.

10. The intake structure of the outboard motor according to claim 9, further comprising a throttle body to which intake air flows from the silencer, wherein an opening part of the silencer connected to the throttle body is located on a higher side than a lower surface of the silencer.

* * * * *